US007490595B2

(12) United States Patent
Brück et al.

(10) Patent No.: US 7,490,595 B2
(45) Date of Patent: Feb. 17, 2009

(54) EXHAUST GAS SYSTEM HAVING AN EXHAUST GAS TREATMENT UNIT AND A HEAT EXCHANGER IN AN EXHAUST GAS RECIRCULATION LINE

(75) Inventors: Rolf Brück, Bergisch Gladbach (DE); Andreas Scheeder, Siegburg (DE); Peter Geskes, Ostfildern (DE); Ulrich Maucher, Korntal-Münchingen (DE); Jens Ruckwied, Stuttgart (DE)

(73) Assignees: Emitec Geseelschaft fur Emissionstechnologie MBH, Lohmar (DE); Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 11/859,942

(22) Filed: Sep. 24, 2007

(65) Prior Publication Data

US 2008/0028747 A1 Feb. 7, 2008

Related U.S. Application Data

(63) Continuation of application No. PCT/EP2006/002702, filed on Mar. 24, 2006.

(30) Foreign Application Priority Data

Mar. 24, 2005 (DE) ..... 10 2005 014 264

(51) Int. Cl.
*F02M 25/07* (2006.01)
*F02B 47/08* (2006.01)
*F01N 3/20* (2006.01)

(52) U.S. Cl. ..... 123/568.12; 60/278

(58) Field of Classification Search ..... 123/568.11, 123/568.12; 60/278, 279, 605.2; 701/108
See application file for complete search history.

(56) References Cited

U.S. PATENT DOCUMENTS 5,785,030 A * 7/1998 Paas ..... 123/568.12
6,516,611 B1 2/2003 Schaefer-Sindlinger et al.
6,826,903 B2 12/2004 Yahata et al.
6,851,414 B2 * 2/2005 Gao et al. ..... 123/568.12
7,013,879 B2 * 3/2006 Brookshire et al. .... 123/568.12

(Continued)

FOREIGN PATENT DOCUMENTS

DE 19923781 C2 12/2000

(Continued)

*Primary Examiner*—Willis R Wolfe, Jr.
(74) *Attorney, Agent, or Firm*—Laurence A. Greenberg; Werner H. Stemer; Ralph E. Locher

(57) ABSTRACT

An exhaust gas system for an internal combustion engine includes an intake system and an exhaust outlet interconnected by an exhaust gas recirculation line having an exhaust treatment unit and a heat exchanger. The heat exchanger has a first back pressure and the exhaust treatment unit has a second back pressure, smaller than the first back pressure. The exhaust treatment unit is disposed at such a first distance from the heat exchanger in flow direction that, during operation, a gas flow entering the exhaust treatment unit is homogenized. The exhaust gas system permits an advantageous configuration of a heat exchanger and an exhaust treatment unit, such as for example a honeycomb body in the exhaust gas recirculation line, in which both the heat exchanger and the exhaust treatment unit can have a smaller structure than in conventional systems. This reduces costs considerably for equipping such a system.

16 Claims, 2 Drawing Sheets

U.S. PATENT DOCUMENTS

| | | | | |
|---|---|---|---|---|
| 7,165,540 | B2 * | 1/2007 | Brookshire et al. | 123/568.12 |
| 7,195,006 | B2 * | 3/2007 | Khair et al. | 123/568.12 |
| 2003/0213230 | A1 | 11/2003 | Yahata et al. | |
| 2005/0115222 | A1 | 6/2005 | Blomquist et al. | |
| 2006/0266019 | A1 * | 11/2006 | Ricart-Ugaz | 60/278 |
| 2007/0051095 | A1 | 3/2007 | Lutz | |

FOREIGN PATENT DOCUMENTS

| | | | |
|---|---|---|---|
| DE | 10322535 | A1 | 2/2004 |
| DE | 102004042454 | A1 | 4/2005 |
| EP | 1503070 | A2 | 2/2005 |
| JP | 2000146465 | A1 | 5/2000 |
| WO | 2005028848 | A1 | 3/2005 |

* cited by examiner

EXHAUST GAS SYSTEM HAVING AN EXHAUST GAS TREATMENT UNIT AND A HEAT EXCHANGER IN AN EXHAUST GAS RECIRCULATION LINE

CROSS-REFERENCE TO RELATED APPLICATION

This is a continuing application, under 35 U.S.C. § 120, of copending International Application No. PCT/EP2006/002702, filed Mar. 24, 2006, which designated the United States; this application also claims the priority, under 35 U.S.C. § 119, of German Patent Application DE 10 2005 014 264.8, filed Mar. 24, 2005; the prior applications are herewith incorporated by reference in their entirety.

BACKGROUND OF THE INVENTION

Field of the Invention

The subject matter of the present invention is an exhaust gas system for internal combustion engines having a heat exchanger and an exhaust gas treatment unit in an exhaust gas recirculation line.

Exhaust gas systems of internal combustion engines are often provided with heat exchangers which are used to cool the exhaust gas, in particular when the exhaust gas is recirculated into an air inlet region of the internal combustion engine. Contamination of the heat exchanger by pollutants present in the exhaust gas reduces its effectiveness, so that when the heat exchanger is configured it has to be basically over dimensioned in order to ensure that the heat exchanger has at least a desired effectiveness over a relatively long time period.

In order to reduce the contamination of the heat exchanger, it is known from the prior art to provide a catalytic converter upstream of the heat exchanger, through the use of which at least long-chained hydrocarbons, that can lead to sticky deposits in the heat exchanger, are removed. Such systems have the disadvantage that either insufficient conversion of the exhaust gas occurs due to the catalytic converter being disposed upstream, so that contamination of the heat exchanger still occurs, or that the catalytic converter has to be given very large dimensions in order to effectively prevent the contamination of the heat exchanger.

SUMMARY OF THE INVENTION

It is accordingly an object of the invention to provide an exhaust gas system having an exhaust gas treatment unit or catalytic converter and a heat exchanger in an exhaust gas recirculation line, which overcomes the hereinafore-mentioned disadvantages of the heretofore-known devices of this general type and in which an effective reduction of contamination of the heat exchanger and at the same time the smallest possible overall volume of the heat exchanger and of the catalytic converter, are obtained.

With the foregoing and other objects in view there is provided, in accordance with the invention, an exhaust gas system for an internal combustion engine. The exhaust gas system comprises an intake system, an exhaust outlet, an exhaust gas recirculation line connected between the exhaust outlet and the intake system, and an exhaust gas treatment unit and a heat exchanger disposed in the exhaust gas recirculation line. The heat exchanger has a first backpressure and the exhaust gas treatment unit has a second backpressure lower than the first backpressure. The exhaust gas treatment unit is disposed at a first distance upstream of the heat exchanger in exhaust gas flow direction, causing a gas flow entering the exhaust gas treatment unit during operation to be homogenized. This means, in particular, that the backpressure upstream of the exhaust gas treatment unit in the direction of flow is influenced by the first backpressure of the heat exchanger.

The heat exchanger is to be understood herein, in particular, as also referring to an exhaust cooler with which the fed-back exhaust gas is cooled. The internal combustion engine is, in particular, a diesel engine, for example a diesel engine of a motor vehicle (for example of a passenger car, a truck, a motor-operated two wheeled vehicle, a boat or an aircraft) or a diesel engine in a stationary application. Homogenization is also to be understood, in particular, as referring to widening of the probability distribution of the speeds which occur.

The construction of the heat exchanger gives rise to the raised backpressure as compared to the exhaust gas treatment unit. In particular, a heat exchanger which has a plurality of tubes through which the exhaust gas flows is advantageous. A cooling medium which flows through the housing of the heat exchanger and is extracted from a non-illustrated cooling circuit of the internal combustion engine, preferably flows around those tubes. In particular, honeycomb bodies, for example ceramic or metallic honeycomb bodies, or else wire mesh bodies, bodies made of metal foam or the like, are suitable as exhaust gas treatment units. Metallic honeycomb bodies can be constructed, in particular, from at least one at least partially structured, metallic layer and, if appropriate, at least one substantially smooth layer which are wound or stacked and twisted together. The layers which are twisted or wound together form cavities through which a fluid can flow and which are bounded by the layers. The layers are, in particular, formed from a material which is resistant to high temperature corrosion, such as Al or Cr steel. The layers can be connected to one another, in particular in a materially joined manner, such as for example through the use of a high temperature brazing method. Both the layers which are substantially smooth and the at least partially structured layers can have, at least in certain areas, microstructures, baffle faces, breakthroughs and/or perforations which promote the mixing of the gas flow even further.

The homogenization of the gas flow before it enters the exhaust gas treatment unit advantageously occurs by virtue of the fact that the exhaust gas treatment unit is formed relatively close upstream of the heat exchanger. This leads to homogenization of the gas flow already in the exhaust gas treatment unit, so that in this case the conversion rate is improved since exhaust gas is applied more uniformly to the cross section of the exhaust gas treatment unit. The volume of the exhaust gas treatment unit can thus be reduced as compared to a customary construction with the same conversion rate of the pollutants in the exhaust gas. The significantly more efficient conversion rate of the pollutants also reduces the contamination of the heat exchanger, so that it can also be given smaller dimensions as compared to conventional heat exchangers.

In order to provide an exhaust gas treatment unit which has only a low backpressure, it is possible to use a honeycomb body which has a relatively low number of cells, for example less than 400 cpsi (cells per square inch), preferably less than 300 cpsi, particularly preferably 200 cpsi and less, in particular even 100 cpsi.

In accordance with another feature of the invention, the first distance is selected in such a way that the effect of the first backpressure and of the second backpressure accumulate.

Accumulation is understood herein, in particular, to refer to the fact that the backpressure which is present upstream of the exhaust gas treatment unit is higher than the second backpressure which the exhaust gas treatment unit would have as such. The backpressure upstream of a component in a flow brings about a type of pressure cushion which causes the flow to change. In an extreme case, the present invention brings about a situation in which only one pressure cushion is formed in front of the exhaust gas treatment unit instead of two areas with a pressure cushion, one in front of the heat exchanger and one in front of the exhaust gas treatment unit, respectively.

The accumulation of the backpressures advantageously leads to a situation in which, before the exhaust gas flows into the exhaust gas treatment unit, it has to overcome a backpressure which is higher than the second backpressure of the exhaust gas treatment unit. Depending on the configuration of the heat exchanger and of the exhaust gas treatment unit, the backpressure is even significantly higher than the second backpressure. Raising the backpressure brings about homogenization of the flow of the exhaust gas treatment unit, and thus of the gas flow through the exhaust gas treatment unit and the heat exchanger.

In accordance with a further feature of the invention, a second distance between a gas inlet end side of the exhaust gas treatment unit and a gas inlet end side of the heat exchanger is less than 60 mm, preferably less than 45 mm and particularly less than 30 mm.

These values have proven especially advantageous. In particular, under customary operating conditions, the effects of the first and of the second backpressure accumulate.

In accordance with an added feature of the invention, the extent of the exhaust gas treatment unit in the direction of flow is less than 100 mm, preferably less than 50 mm and particularly preferably 25 mm or less.

Due to the very homogenous and effective conversion of the corresponding substances in the exhaust gas, in particular of hydrocarbons, relatively small exhaust gas treatment units can be used.

In accordance with an additional feature of the invention, the exhaust gas treatment unit includes a honeycomb body.

With a honeycomb body, it is possible to provide an exhaust gas treatment unit having properties, such as surface, backpressure etc., which can be set very precisely. In particular, metallic or ceramic honeycomb bodies are suitable to be used as the honeycomb bodies. In particular, honeycomb bodies such as are described, for example, in German Published, Non-Prosecuted Patent Application DE 197 55 703 A1 and International Publication No. WO 99/11911 A1, corresponding to U.S. Pat. No. 6,660,235, as well as in International Publication No. WO 90/13736 A1, can advantageously be used. Reference is made to the entire contents of those applications and patent and they are incorporated by reference herein, with respect to the attachment of the honeycomb body.

In accordance with yet another feature of the invention, the first distance between the exhaust gas treatment unit and the heat exchanger is less than 15 mm, preferably less than 10 mm and particularly less than 5 mm.

In particular, it is also advantageous to provide the heat exchanger and exhaust gas treatment unit in a common housing. In this context, the exhaust gas treatment unit can be held in a corresponding bead, seam or corrugation of the housing through the use of flanging, crimping, beading or the like. It is also possible to fit the exhaust gas treatment unit flush onto an end side of the heat exchanger.

In accordance with yet a further feature of the invention, the exhaust gas treatment unit has a catalytically active coating, in particular an oxidation catalyst coating.

The catalytically active coating includes, for example, a ceramic wash coat which contains materials that catalyze the desired reactions, that is to say in particular reduce the reaction temperature of these reactions to such an extent that they occur to an appreciable extent at the temperatures in the exhaust gas recirculation line. In particular, noble metals such as platinum, rhodium or the like are suitable as catalysts. The oxidation catalyst coating catalyzes, in particular, the oxidation of hydrocarbons since they are also responsible for the contamination of the heat exchanger. The hydrocarbons form a sticky substance which condenses on the cold areas of the heat exchanger and which can also cause soot particles contained in the exhaust gas to stick to the walls of the heat exchanger. The oxidation of hydrocarbons therefore leads, in a particularly advantageous way, to a significant reduction in the contamination of the heat exchanger. In particular, in exhaust gas systems of diesel engines, very wide ranging, up to complete oxidation of the hydrocarbons occurs due to the relatively high proportion of oxygen in the exhaust gas.

In order to achieve the maximum possible conversion efficiency of the oxidation of the hydrocarbons, the exhaust gas treatment unit is, in particular, formed in such a way that the dwell time is as long as possible and the surface available for the reaction is as large as possible.

In accordance with a concomitant feature of the invention, the ratio of the first backpressure to the second backpressure is greater than 2 and preferably greater than 10.

In particular, under these backpressure conditions, that is to say when the backpressure of the heat exchanger as such is greater than the backpressure of the exhaust gas treatment unit as such, by a factor of 2 or even 10, the effects of the first backpressure of the heat exchanger and of the second backpressure of the exhaust gas treatment unit accumulate in a particularly advantageous way, even at first distances of 15 mm or less.

Other features which are considered as characteristic for the invention are set forth in the appended claims.

Although the invention is illustrated and described herein as embodied in an exhaust gas system having an exhaust gas treatment unit and a heat exchanger in an exhaust gas recirculation line, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
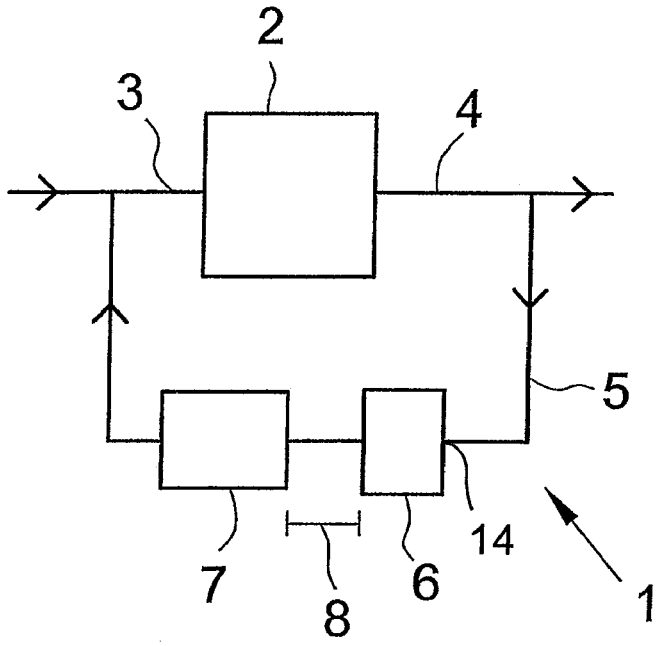
FIG. 1 is a block diagram of a first exemplary embodiment of an exhaust gas system according to the invention.

Referring now to the figures of the drawings in detail and first, particularly, to FIG. 1 thereof, there is seen a block diagram of a first exemplary embodiment of an exhaust gas system 1 according to the invention, for an internal combustion engine 2. The internal combustion engine 2 includes an intake system 3 and an exhaust outlet 4. The exhaust outlet 4 and the intake system 3 are interconnected through an exhaust gas recirculation line 5 in which an exhaust gas treatment unit 6 and a heat exchanger 7 are provided. The heat exchanger 7 has a first backpressure, and the exhaust gas treatment unit 6 has a second backpressure which is lower than the first backpressure. The customary direction of flow of the exhaust gas has been symbolized by corresponding arrows. The quantity of exhaust gas which flows through the exhaust gas recirculation line 5 can be regulated, for example, through the use of corresponding non-illustrated valves. The exhaust gas recirculation line 5 can branch off on the exhaust gas side, either upstream or downstream of a non-illustrated exhaust gas turbocharger.

According to the invention, the exhaust gas treatment unit 6 is provided at a first distance 8 upstream of the heat exchanger 7 in the direction of flow, such that during operation, a gas flow 14 which enters the exhaust gas treatment unit 6 is homogenized. The first distance 8 is, in particular, less than 15 mm, preferably less than 10 mm, particularly preferably less than 5 mm. The heat exchanger 7 and the exhaust gas treatment unit 6 are constructed in such a way that, at this first distance 8, the effects of the first backpressure and of the second backpressure are accumulated so that the exhaust gas flowing into the exhaust gas treatment unit 6 has to overcome a backpressure which is higher than the second backpressure of the exhaust gas treatment unit 6. This leads to a situation, as explained above, in which the gas flow 14 that flows into the exhaust gas treatment unit 6 is homogenized.

Figure 2:
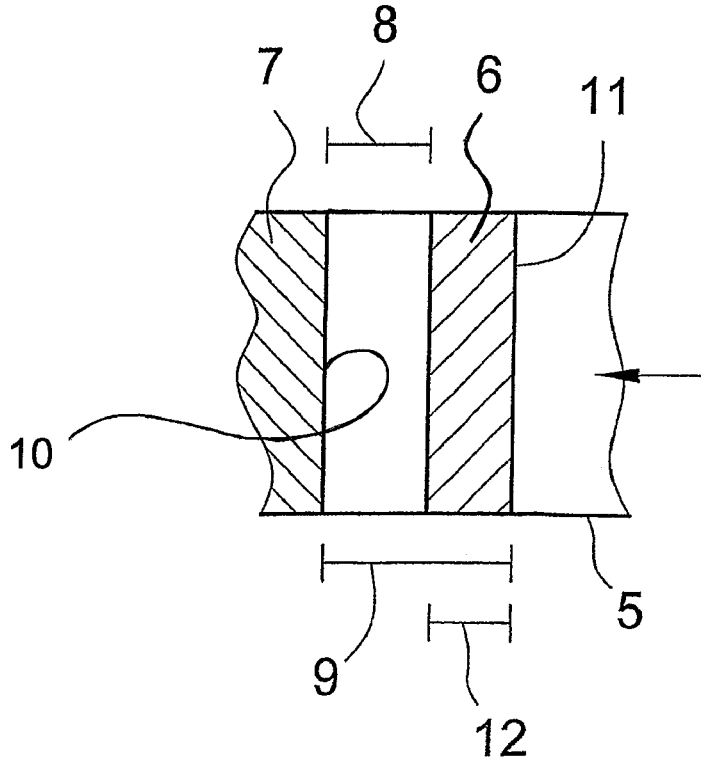
FIG. 2 is a fragmentary, partially sectional view of the first exemplary embodiment of the exhaust gas system according to the invention.

FIG. 2 is a fragmentary, diagrammatic view of the exhaust gas recirculation line 5, including the exhaust gas treatment unit 6 and the heat exchanger 7. A second distance 9 between a gas inlet end side 10 of the heat exchanger 7 and a gas inlet end side 11 of the exhaust gas treatment unit 6 is selected according to the invention in such a way that the flow in the exhaust gas treatment unit 6 is homogenized. In particular, the second distance 9 is less than 60 mm, preferably less than 45 mm, particularly preferably less than 30 mm. In particular, short honeycomb bodies, especially with an extent 12 in the direction of flow of approximately 20 to approximately 40 mm, can be used as the exhaust gas treatment unit 6. The first distance 8 is, for example, less than 15 mm or else 5 mm or less. In particular, the first distance 8 is selected in such a way that the effect of the first backpressure of the heat exchanger 7 and of the second backpressure of the exhaust gas treatment unit 6 accumulate, so that the exhaust gas which flows into the exhaust gas treatment unit 6 has to overcome a backpressure which is higher, preferably significantly higher, than the second backpressure of the exhaust gas treatment unit 6.

Figure 3:
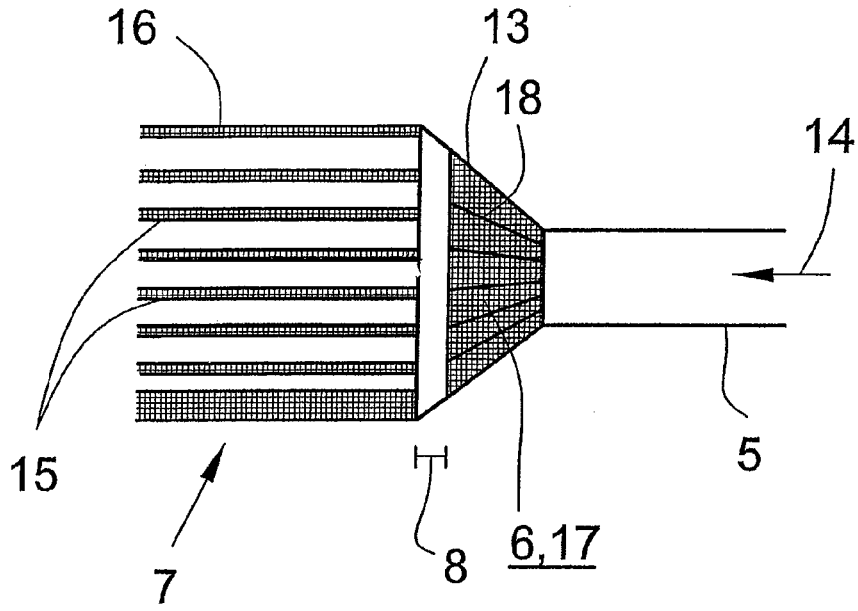
FIG. 3 is a fragmentary, longitudinal-sectional view of a second exemplary embodiment of an exhaust gas system according to the invention.

FIG. 3 is a fragmentary, diagrammatic view of a further exemplary embodiment of an exhaust gas system 1 according to the invention. In this case, a cone 13 which includes the exhaust treatment unit 6 that is constructed as a honeycomb body 17 with passages 18 which are conical in this case, is provided in the exhaust gas recirculation line 5. The gas flow 14 which passes through the exhaust gas recirculation line 5 is directed to the heat exchanger 7 by the cone 13. The heat exchanger 7 includes exhaust tubes or pipes 15 in a housing 16. The gas flow 14 passes through the exhaust tubes 15 and a coolant, which is part of the cooling circuit of the internal combustion engine 2, flows around the exhaust tubes 15 in the housing 16. The first distance 8 between the heat exchanger 7 and the exhaust gas treatment unit 6 is selected according to the invention in such a way that during operation, the gas flow 14 which enters the exhaust gas treatment unit 6 is homogenized.

Figure 4:
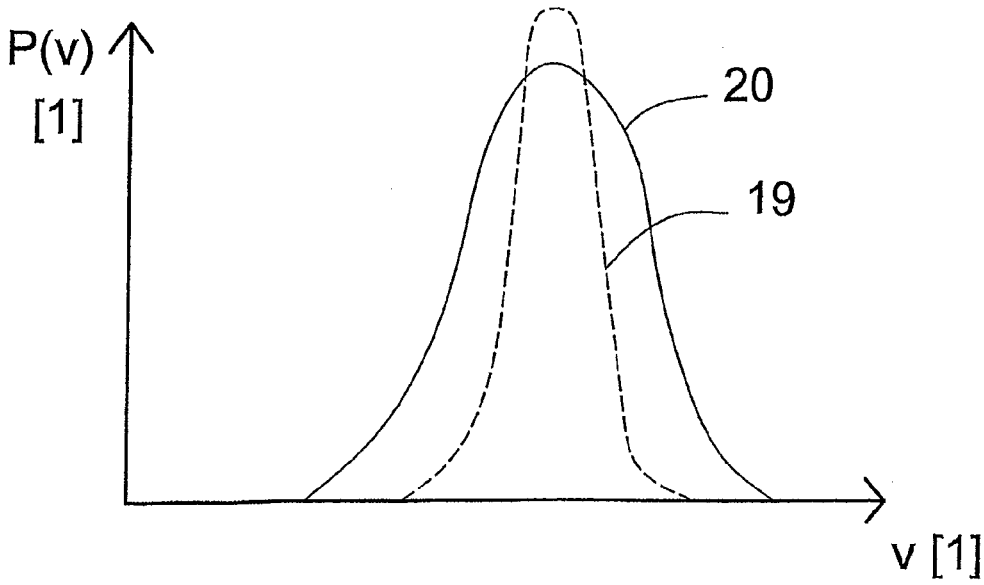
FIG. 4 is a graph showing two probability distributions of a flow speed.

FIG. 4 is a graph showing a first probability distribution 19 of a speed v and a second probability distribution 20 of the speed v. The first probability distribution 19 is obtained if gas flows only through the exhaust gas treatment unit 6, that is to say without a heat exchanger 7 being provided downstream of the exhaust gas treatment unit 6 in the direction of flow. The probability of a certain speed being present in the gas is plotted for both distributions. Both the probability and the speed are given in relative units. The second probability distribution 20 is the probability distribution in a system according to the invention. It relates, therefore, to an exhaust gas system 1 with a heat exchanger 7 and an exhaust gas treatment unit 6 in an exhaust gas recirculation line 5. The second probability distribution 20 is wider and has, in particular, a greater width with half the maximum height (full width half maximum) of the first probability distribution 19. This is due to the homogenization of the flow according to the invention.

The exhaust gas system according to the invention advantageously permits a heat exchanger 7 and an exhaust gas treatment unit 6, such as for example a honeycomb body, to be formed in the exhaust gas recirculation line 5, and at the same time both the heat exchanger 7 and the exhaust gas treatment unit 6 can be made smaller than is customary. This provides considerable cost savings when configuring such systems.

The invention claimed is:

1. An exhaust gas system for an internal combustion engine, the exhaust gas system comprising:

an intake system;

an exhaust outlet;

an exhaust gas recirculation line connected between said exhaust outlet and said intake system;

an exhaust gas treatment unit and a heat exchanger disposed in said exhaust gas recirculation line, said heat exchanger having a first backpressure and said exhaust gas treatment unit having a second backpressure lower than said first backpressure; and said exhaust gas treatment unit disposed at a first distance upstream of said heat exchanger in exhaust gas flow direction, causing a gas flow entering said exhaust gas treatment unit during operation to be homogenized.

2. The exhaust gas system according to claim 1, wherein said first distance causes an effect of said first backpressure and of said second backpressure to accumulate.

3. The exhaust gas system according to claim 1, wherein said exhaust gas treatment unit has a gas inlet end side, and said heat exchanger has a gas inlet end side spaced apart from said gas inlet end side of said exhaust gas treatment unit by a second distance of less than 60 mm.

4. The exhaust gas system according to claim 1, wherein said exhaust gas treatment unit has a gas inlet end side, and said heat exchanger has a gas inlet end side spaced apart from said gas inlet end side of said exhaust gas treatment unit by a second distance of less than 45 mm.

5. The exhaust gas system according to claim 1, wherein said exhaust gas treatment unit has a gas inlet end side, and said heat exchanger has a gas inlet end side spaced apart from said gas inlet end side of said exhaust gas treatment unit by a second distance of less than 30 mm.

6. The exhaust gas system according to claim 1, wherein said exhaust gas treatment unit has an extent, in said exhaust gas flow direction, of less than 100 mm.

7. The exhaust gas system according to claim 1, wherein said exhaust gas treatment unit has an extent, in said exhaust gas flow direction, of less than 50 mm.

8. The exhaust gas system according to claim 1, wherein said exhaust gas treatment unit has an extent, in said exhaust gas flow direction, of 25 mm or less.

9. The exhaust gas system according to claim 1, wherein said first distance between said exhaust gas treatment unit and said heat exchanger is less than 15 mm.

10. The exhaust gas system according to claim 1, wherein said first distance between said exhaust gas treatment unit and said heat exchanger is less than 10 mm.

11. The exhaust gas system according to claim 1, wherein said first distance between said exhaust gas treatment unit and said heat exchanger is less than 5 mm.

12. The exhaust gas system according to claim 1, wherein said exhaust gas treatment unit includes a honeycomb body.

13. The exhaust gas system according to claim 1, wherein said first backpressure and said second backpressure are in a ratio of greater than 2.

14. The exhaust gas system according to claim 1, wherein said first backpressure and said second backpressure are in a ratio of greater than 10.

15. The exhaust gas system according to claim 1, wherein said exhaust gas treatment unit includes a catalytically active coating.

16. The exhaust gas system according to claim 15, wherein said catalytically active coating is an oxidation catalyst coating.

* * * * *